US008807218B2

(12) United States Patent
Kleefisch et al.

(10) Patent No.: US 8,807,218 B2
(45) Date of Patent: Aug. 19, 2014

(54) TELESCOPIC LASER PURGE NOZZLE

(75) Inventors: Mark S Kleefisch, Plainfield, IL (US); Iraj Salehi, Naperville, IL (US)

(73) Assignee: Gas Technology Institute, Des Plaines, IL (US)

( * ) Notice: Subject to any disclaimer, the term of this patent is extended or adjusted under 35 U.S.C. 154(b) by 225 days.

(21) Appl. No.: 13/206,570

(22) Filed: Aug. 10, 2011

(65) Prior Publication Data

US 2013/0037268 A1 Feb. 14, 2013

(51) Int. Cl.
*E21B 43/11* (2006.01)

(52) U.S. Cl.
USPC ..... 166/297; 175/11; 175/12; 175/15; 219/121.7; 219/121.71; 219/121.84

(58) Field of Classification Search
CPC ..... E21B 49/06
USPC ..... 219/121.7, 121.71, 121.84; 166/297; 175/11, 12, 65
See application file for complete search history.

(56) References Cited

U.S. PATENT DOCUMENTS

| | | | | |
|---|---|---|---|---|
| 2,941,338 | A * | 6/1960 | Santschi | 451/195 |
| 3,277,964 | A * | 10/1966 | Houpeurt et al. | 166/285 |
| 3,447,652 | A | 6/1969 | Tipton | |
| 3,461,964 | A * | 8/1969 | Venghiattis | 166/297 |
| 3,749,878 | A * | 7/1973 | Sullivan et al. | 219/121.67 |
| 4,227,582 | A * | 10/1980 | Price | 175/16 |
| 4,354,558 | A * | 10/1982 | Jageler et al. | 175/45 |
| 4,698,479 | A * | 10/1987 | Rando et al. | 219/121.79 |
| 4,880,065 | A * | 11/1989 | McDonald et al. | 175/71 |
| 5,367,943 | A * | 11/1994 | Stoll et al. | 92/2 |
| 6,888,097 | B2 | 5/2005 | Batarseh | |
| 7,438,132 | B2 | 10/2008 | Cook et al. | |
| 7,490,664 | B2 | 2/2009 | Skinner et al. | |
| 7,866,399 | B2 | 1/2011 | Kozicz et al. | |
| 7,872,810 | B2 | 1/2011 | Nomura et al. | |
| 2005/0126465 | A1 * | 6/2005 | Wilcox et al. | 114/255 |
| 2010/0326659 | A1 * | 12/2010 | Schultz et al. | 166/297 |
| 2011/0048741 | A1 * | 3/2011 | Durst | 166/384 |

* cited by examiner

*Primary Examiner* — Jennifer H Gay
*Assistant Examiner* — George Gray
(74) *Attorney, Agent, or Firm* — Pauley Petersen & Erickson

(57) ABSTRACT

A method and apparatus for wellbore perforation in which a laser beam at a downhole location of a wellbore is directed to a target area of a wellbore wall to be perforated. The laser beam is guided through a longitudinally extensible nozzle onto the target area and a purge fluid is introduced into the longitudinally extensible nozzle, thereby longitudinally extending the nozzle toward the target area. The purge fluid in the longitudinally extensible nozzle is passed through a purge fluid outlet of the nozzle onto the target area, thereby removing debris from the target area generated by the laser beam.

13 Claims, 3 Drawing Sheets

TELESCOPIC LASER PURGE NOZZLE

BACKGROUND OF THE INVENTION

1. Field of the Invention

This invention relates to a method and apparatus for subterranean drilling. In one aspect, this invention relates to a method and apparatus for completion of oil, gas and/or hydrothermal wells. In one aspect, this invention relates to the use of lasers for subterranean drilling, including initiation and promotion of flow of a desired resource into a wellbore, referred to herein as perforation. In one aspect, this invention relates to a method and apparatus for removal of debris produced by lasers during subterranean drilling. In yet another aspect, this invention relates to the use of extensible laser head assemblies for perforation of wellbores.

2. Description of Related Art

Once the drilling of a wellbore has been completed, fluid flow into the wellbore is initiated by perforating the wellbore casing or liner. Such perforations are normally created using bullets or shaped charges for establishing flow of oil or gas from the geologic formations surrounding the wellbore into the wellbore. However, there are numerous problems with this approach. For example, the melt from shaped charges or debris from the bullet impact usually reduces the permeability of the producing formations resulting in a substantial reduction in production rate. In addition, these techniques involve the transportation and handling of high power explosives and are causes of serious safety and security concerns. Moreover, the impact of the bullet into the formation also produces fine grains that can plug the pore throat, thereby reducing the production rate. And, finally, the depth of the perforations into the formations is limited to a few inches.

In an attempt to address certain of these issues, U.S. Pat. No. 6,888,097 to Batarseh teaches the use of laser energy for creating the perforations. More particularly, the '097 patent teaches a high power laser disposed above ground coupled with a fiber optic cable that transmits laser energy downhole. On the end of the fiber optic cable is a mechanical means that allows for precise control over the motion and location of the fiber optic cable. In accordance with one embodiment, a plurality of spherical wheels or other suitable means of locomotion mounted on retractable mechanical arms are connected with the fiber optic cable. After the laser penetrates the wellbore casing and cement, the fiber optic cable can be transported through each medium into the actual perforation, allowing for the creation of a much deeper perforation. The apparatus is capable not only of drilling deeper into the perforated opening, but also of acting upon the surface of the perforation. Different types of laser treatments can be employed to yield fully vaporized (high permeability), porous melt (moderate permeability) or sealed (impermeable) rock layers. These different treatments are required to cope with the different strengths and stabilities of the rock formations encountered. The desired results can be obtained by manipulating simple laser parameters, such as laser power and exposure time.

There are, however, certain disadvantages associated with the method and apparatus of the '097 patent and there are certain issues associated with wellbore perforation by conventional means that are not addressed by the teachings of the '097 patent. One of the disadvantages is that the method and apparatus require that the fiber optic cable be transported by the means of locomotion into the perforation to limit the distance between the fiber optic cable end and the target area to minimize attenuation of the laser energy due to the disposition of debris generated by the laser during the perforation process in the pathway of the laser beam.

SUMMARY OF THE INVENTION

The method and apparatus of this invention address these and other disadvantages and issues by enabling the end of the fiber optic cable from which the laser beam is emitted to remain in the wellbore during the process of perforation while providing a substantially unobstructed pathway for the laser energy from the fiber optic cable end to the target area.

In particular, the apparatus for wellbore perforation in accordance with one embodiment of this invention comprises a drill string having a downhole end, a laser energy source, laser energy transmission means for transmitting laser energy from the laser energy source to the downhole end of the drill string, a longitudinally extensible nozzle extendable between an extended position and a retracted position having a drill string end connected with the downhole end of the drill string and having a drilling end, wherein the nozzle is adapted to transmit the laser energy from the downhole end of the drill string to the drilling end, the longitudinally extensible nozzle having a purge fluid inlet in fluid communication with a purge fluid source and having a purge fluid outlet proximate the drilling end, a rotary drill bit connected with the drilling end of the longitudinally extensible nozzle, and a pneumatically driven rotary vane motor disposed within the longitudinally extensible nozzle proximate the drilling end and adapted to rotate the rotary drill bit. Thus, the longitudinally extensible nozzle provides a clear pathway for the laser beam from the drill string end to the target area thereby enabling maintaining of the laser energy source outlet within the wellbore during the perforation process. In addition, extension of the longitudinally extensible nozzle is accomplished solely by the motive forces of a purge fluid provided to the interior of the nozzle, which purge fluid may also be used to remove debris generated by the perforation process from the perforation target area as well as to rotate the pneumatically driven vane motor for rotation of the rotary drill bit.

BRIEF DESCRIPTION OF THE DRAWINGS

These and other objects and features of this invention will be better understood from the following detailed description taken in conjunction with the drawings, wherein.

DETAILED DESCRIPTION OF THE PRESENTLY PREFERRED EMBODIMENTS

Figure 1:
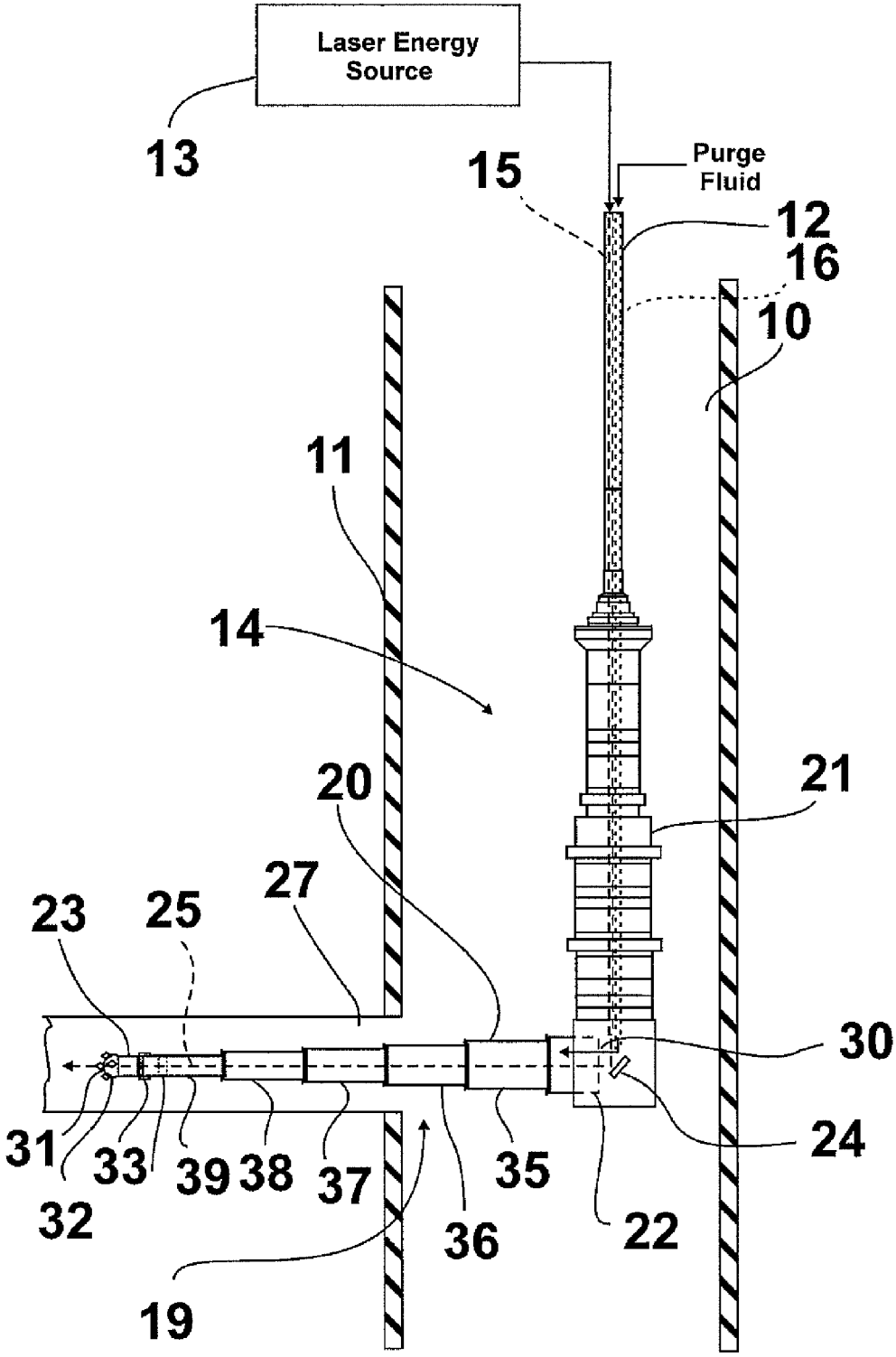
FIG. 1 is a schematic diagram of a telescopic laser drilling apparatus in accordance with one embodiment of this invention.

The invention described herein is a laser energy-based method and apparatus for the perforation of wellbores. FIG. 1 shows an apparatus in accordance with one embodiment of this invention disposed in a wellbore 10 having a wellbore wall in the form of a casing or liner 11. The apparatus comprises a drill string connected with a drilling rig (not shown)

disposed above ground. The drill string has a downhole end 12 with which is connected a laser drilling assembly 14. The apparatus further comprises a laser energy source 13, typically disposed above ground, and laser energy transmission means for transmitting the laser energy from the laser energy source to the downhole end of the drill string. In accordance with one embodiment of this invention, the laser transmission means comprises a fiber optic cable 15 comprising one or more light transmissive optical fibers disposed inside the drill string. It will be appreciated that other forms of laser energy transmission may be employed, such as a conduit containing a light transmissive fluid, and such alternative forms are deemed to be within the scope of this invention.

Disposed proximate the lower end of the laser drilling assembly 14 in accordance with one embodiment of this invention is a mirror 24 which is aligned to receive laser energy from the output end of the fiber optic cable and divert the laser energy in the direction of a wellbore perforation target area. A longitudinally extensible nozzle 19 having a nozzle input end 22 and a nozzle output end or drilling end 23 is operably connected by suitable connecting means 21 to the downhole end of the drill string. It will be appreciated that there are a number of ways by which this connection may be made. However, principle among the requirements of such connection means is the ability to transmit laser energy from the drill string end to the nozzle input end of the longitudinally extensible nozzle. The longitudinally extensible nozzle is moveable between an extended position as shown in FIG. 1 and a retracted position and is adapted to transmit laser energy 25 from the nozzle input end to the nozzle output end of the nozzle. In addition, the longitudinally extensible nozzle is provided with a purge fluid inlet 30 in fluid communication with a purge fluid source and is provided with a purge fluid outlet 31 proximate the drilling end of the nozzle. The purge fluid, which may be any environmentally non-reactive liquid or gas, is used to remove debris from the perforation target area during the perforation process and may be transmitted by means of a purge fluid conduit 16 disposed inside the drill string. In addition, the purge fluid may be used to extend the longitudinally extensible nozzle from its retracted position to an extended position in accordance with one embodiment of this invention. The extent to which the longitudinally extensible nozzle is extended is based upon the depth of the perforation 27. In particular, as the perforation gets deeper, the nozzle may be extended further. Retraction of the extended nozzle may be achieved through the use of a spring module. In accordance with another embodiment of this invention, retraction of the extended nozzle may be achieved through the use of differential pressure between the tool internals and tool externals.

In addition to the use of laser energy from perforating the wellbore wall, the apparatus of this invention further comprises a rotary drill bit 31 connected with the drilling end of the nozzle. Disposed within the longitudinally extensible nozzle proximate the outlet end thereof is a pneumatically driven vane motor 33, which is driven by the purge fluid provided to the nozzle and which is operably connected with the rotary drill bit 31 to enable rotation thereof as necessary. To provide access of the perforation target area to the laser energy, the rotary drill bit is provided with at least one drill bit laser energy passageway. In addition, in accordance with one embodiment of this invention, the rotary drill bit is further provided with a purge fluid outlet to enable the purge fluid to reach the perforation target area. It will, thus, be appreciated that the purge fluid is multi-functional—a driving force for extending the length of the longitudinally-extensible nozzle, a driving force for rotating the rotary drill bit, a debris removal force for removing debris generated during the wellbore perforation process from the wellbore wall perforation target area, and as a pathway for transmission of the laser energy through the length of the longitudinally extensible nozzle. To the extent that the purge fluid is used as a pathway for the laser energy, the purge fluid must be light transmissive.

As shown in FIG. 1, the longitudinally extensible nozzle comprises a plurality of coaxially aligned telescoping tubular members 35, 36, 37, 38, 39 wherein a smaller tubular member, e.g. tubular member 36, is telescopically retractable and extensible from within a larger tubular member, e.g. tubular member 35. The maximum length to which the longitudinally extensible nozzle may be extended may be varied by varying the number of telescoping tubular members employed. That is, the maximum length may be increased by increasing the number of telescoping tubular members of a given length. In accordance with one preferred embodiment of this invention, the telescoping tubular members are equal in length. Although not required, the minimum retracted length of the longitudinally extensible nozzle in accordance with one embodiment of this invention is achieved through the use of equal length telescoping tubular members.

Figure 2:
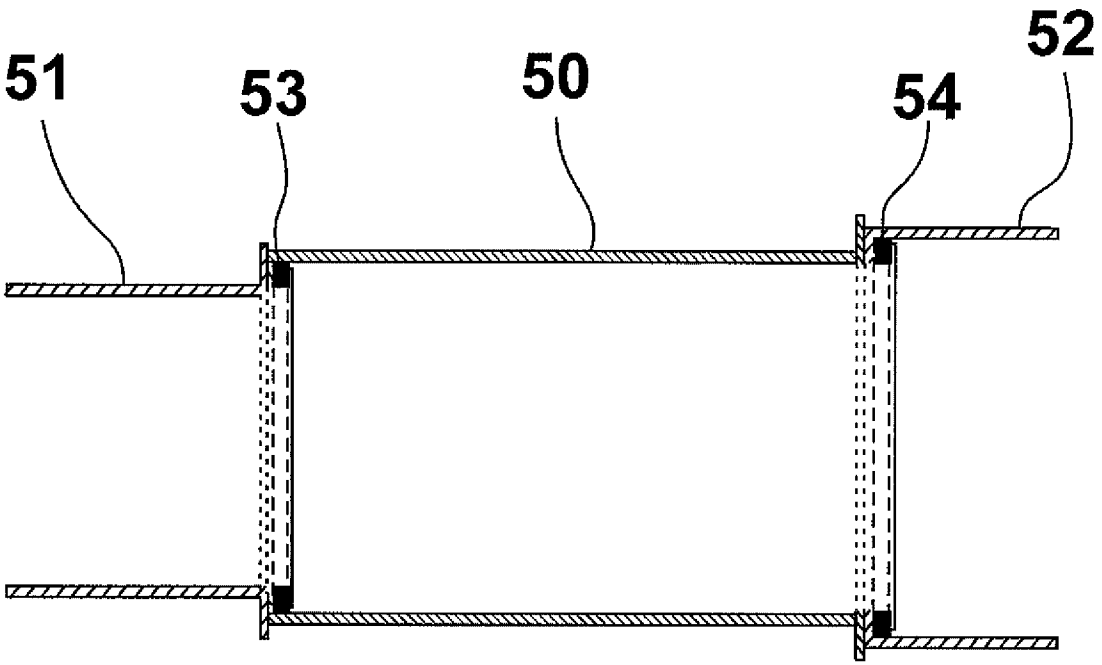
FIG. 2 is an enlarged view of a section of the telescopic nozzle of a telescopic laser drilling apparatus in accordance with one embodiment of this invention.

In order to prevent the intake of fluids from the surrounding downhole environment or the leakage of purge fluid into the surrounding downhole environment prior to discharge from the nozzle outlet end of the nozzle, seals are provided to seal the interfaces between adjacent telescoping tubular members. In addition to sealing, the seals in accordance with one embodiment of this invention provide a bearing surface for the outer surface of an inner tubular member to slide upon during extension and retraction of the nozzle. FIG. 2 shows a tubular member 50 between adjacent tubular members 51, 52 and seals 53, 54 for sealing the interfaces between the adjacent tubular members. In accordance with one preferred embodiment of this invention, the seals are TEFLON polytetrafluoroethylene fluorocarbon rings, thereby enabling not only inter-tubular sealing, but also facilitating sliding of the tubular members.

In order to prevent the intake of fluids from the surrounding downhole environment or the leakage of purge fluid into the surrounding downhole environment prior to discharge from the nozzle outlet end of the nozzle, seals are provided to seal the interfaces between adjacent telescoping tubular members. In addition to sealing, the seals in accordance with one embodiment of this invention provide a bearing surface for the outer surface of an inner tubular member to slide upon during extension and retraction of the nozzle. FIG. 2 shows a tubular member 50 between adjacent tubular members 51, 52 and seals 53, 54 for sealing the interfaces between the adjacent tubular members. In accordance with one preferred embodiment of this invention, the seals are TEFLON polytetrafluoroethylene fluorocarbon rings, thereby enabling not only inter-tubular sealing, but also facilitating sliding of the tubular members.

As previously described, a pneumatically driven rotary vane motor disposed proximate the outlet end of the telescoping tubular nozzle is used to drive a rotary drill bit attached to the outlet end of the nozzle using a purge fluid as the driving fluid. It will be appreciated by those skilled in the art that use of a vane motor as described may impart a force upon the tubular members so as to cause the tubular members to rotate relative to one another around the longitudinal axis of the nozzle, thereby reducing the effectiveness of the motor, particularly where the tubular members have a cylindrical shape as shown in FIG. 3A. Accordingly, in accordance with one embodiment of this invention, the telescoping tubular members comprise locking means for preventing such relative rotation. In accordance with one preferred embodiment as shown in FIG. 3A, the locking means comprise at least one locking pin 60 extending from an outer surface of each inner tubular member into a groove or channel 61 formed by an adjacent tubular member, which groove or channel is elongated in a direction parallel to the longitudinal axis of the telescoping nozzle so as to slide within the groove or channel during extension or retraction of the tubular members while preventing relative rotation of the tubular members around the longitudinal axis. It will be appreciated by those skilled in the art that the locking pins could extend from the interior surfaces of the tubular members into grooves or channels formed by the exterior surface of the adjacent tubular member, or a combination thereof, and such embodiments are to be understood to be within the scope of this invention.

Figure 3B:
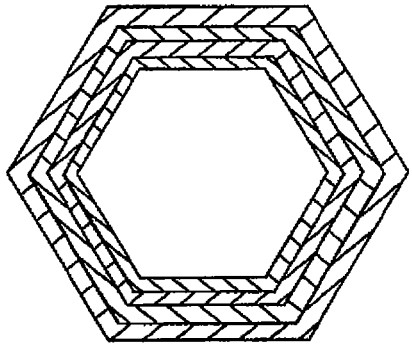
FIG. 3B is a radial cross-sectional view of a telescopic nozzle looking in the direction of the outlet end of the nozzle in accordance with another embodiment of this invention.
Figure 3A:
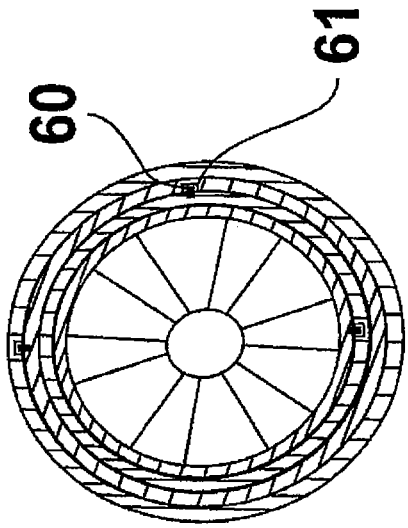
FIG. 3A is a radial cross-sectional view of a telescopic nozzle looking in the direction of the outlet end of the nozzle in accordance with one embodiment of this invention.

In accordance with another embodiment as shown in FIG. 3B, the locking means comprises tubular members of the telescopic nozzle having a non- circular shape, e.g. oval or polygonal, which precludes relative rotation of the tubular members.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. An apparatus for wellbore perforation comprising: a drill string having a downhole end; a laser energy source; laser energy transmission means for transmitting laser energy from said laser energy source to said downhole end of said drill string; a longitudinally extensible nozzle extendable between an extended position and a retracted position having a drill string end connected with said downhole end of said drill string and having a drilling end, said nozzle adapted to transmit said laser energy from said downhole end of said drill string to said drilling end; said longitudinally extensible nozzle having a purge fluid inlet in fluid communication with a purge fluid source and having a purge fluid outlet proximate said drilling end; a rotary drill bit connected with said drilling end of said longitudinally extensible nozzle; and a pneumatically driven rotary vane motor disposed within said longitudinally extensible nozzle proximate said drilling end and adapted to rotate said rotary drill bit.

2. The apparatus of claim 1, wherein said longitudinally extensible nozzle comprises a plurality of coaxially aligned telescoping tubular members wherein a smaller tubular member is telescopically retractable into and extensible from within a larger tubular member.

3. The apparatus of claim 2 further comprising a seal for sealing between said telescoping tubular members.

4. The apparatus of claim 2, wherein said telescoping tubular members have a cylindrical shape.

5. The apparatus of claim 4 further comprising locking means for preventing relative rotation of said telescoping tubular members around a longitudinal axis of said longitudinally extensible nozzle.

6. The apparatus of claim 5, wherein said locking means comprises a locking pin connected with one of said telescoping tubular members and extending into a longitudinally oriented groove formed by an adjacent telescoping tubular member, said groove having a width substantially corresponding to a diameter of said locking pin.

7. The apparatus of claim 2, wherein said telescoping tubular members have matching polygonal shapes whereby relative rotation of said telescoping members around a longitudinal axis of said longitudinally extensible nozzle is prevented.

8. The apparatus of claim 1, wherein said longitudinally extensible nozzle extends from a retracted position to an extended position with passage of the purge fluid through said longitudinally extensible nozzle.

9. A method for perforating a wellbore comprising the steps of:

providing a laser beam to a downhole location of the wellbore and directing said laser beam to a target area of a wellbore wall to be perforated, wherein said providing and directing includes introducing said laser beam into a laser beam inlet of a longitudinally extensible nozzle having a drilling end and passing said laser beam through a laser beam outlet proximate said drilling end of said longitudinally extensible nozzle onto said target area;

introducing a purge fluid into said longitudinally extensible nozzle, thereby longitudinally extending said longitudinally extensible nozzle toward said target area; and directing said purge fluid in said longitudinally extensible nozzle through a purge fluid outlet proximate said drilling end onto said target area, thereby removing debris from said target area generated by said laser beam; and further wherein a rotary drill bit is connected with said drilling end of said longitudinally extensible nozzle, said rotary drill bit adapted to transmit said laser beam through said drill bit onto said target area.

10. The method of claim 9, wherein said rotary drill bit is rotated by a pneumatically driven rotary vane motor disposed in said longitudinally extensible nozzle proximate said drilling end and driven by said purge fluid.

11. The method of claim 9, wherein said longitudinally extensible nozzle is longitudinally extended toward said target area as a perforation depth of a perforation produced in said wellbore wall increases.

12. The method of claim 9, wherein said longitudinally extensible nozzle comprises a plurality of coaxially aligned telescoping tubular members wherein a smaller tubular member is telescopically retractable into and extensible from within a larger tubular member.

13. The method of claim 12, wherein said coaxially aligned telescoping tubular members are precluded from relative rotation around a longitudinal axis of said longitudinally extensible nozzle.

* * * * *